US008585450B2

(12) United States Patent
von Wolske

(10) Patent No.: US 8,585,450 B2
(45) Date of Patent: Nov. 19, 2013

(54) WATER FLOW LIMITING SYSTEM FOR A BOAT INCLUDING A WATER FLOW LIMITING PLATE POSITIONED RELATIVE TO PROPELLER SHAFT AND PROPELLER OF A BOAT FOR LIMITING WATER FLOW TO THE PROPELLER

(76) Inventor: James P. von Wolske, Austin, TX (US)

( * ) Notice: Subject to any disclaimer, the term of this patent is extended or adjusted under 35 U.S.C. 154(b) by 177 days.

(21) Appl. No.: 12/623,392

(22) Filed: Nov. 21, 2009

(65) Prior Publication Data

US 2010/0136859 A1 Jun. 3, 2010

Related U.S. Application Data

(60) Provisional application No. 61/117,662, filed on Nov. 25, 2008.

(51) Int. Cl.

| | |
|---|---|
| ***B63H 1/18*** | (2006.01) |
| ***B63H 1/28*** | (2006.01) |
| ***B63H 5/16*** | (2006.01) |

(52) U.S. Cl.
USPC ..... 440/66

(58) Field of Classification Search
USPC ..... 440/49, 53, 61 S, 61 R, 61 T, 61 E, 61 F, 440/61 G, 63, 66, 76; 114/271, 274, 114/278–281, 284–286
See application file for complete search history.

(56) References Cited

U.S. PATENT DOCUMENTS

| | | | | |
|---|---|---|---|---|
| 2,054,374 | A * | 9/1936 | Fuller | 440/71 |
| 2,415,183 | A * | 2/1947 | Law | 440/62 |
| 2,514,278 | A * | 7/1950 | Dunn et al. | 56/17.4 |
| 2,691,954 | A * | 10/1954 | Shively | 440/58 |
| 4,096,819 | A | 6/1978 | Evinrude | |
| 4,544,362 | A | 10/1985 | Arneson | |
| 4,597,742 | A * | 7/1986 | Finkl | 440/61 R |
| 4,645,463 | A | 2/1987 | Arneson | |
| 5,007,869 | A * | 4/1991 | Zoellner | 440/71 |
| 5,046,975 | A | 9/1991 | Buzzi | |
| 5,100,350 | A | 3/1992 | Buzzi | |
| 5,171,175 | A | 12/1992 | Buzzi | |
| 5,806,455 | A | 9/1998 | Buzzi | |
| 6,464,549 | B2 | 10/2002 | Buzzi | |
| 6,823,812 | B2 | 11/2004 | von Wolske | |
| 7,013,825 | B1 | 3/2006 | D'Alessandro | |
| 7,335,074 | B2 | 2/2008 | Arneson | |

* cited by examiner

*Primary Examiner* — Daniel Venne
(74) *Attorney, Agent, or Firm* — Gary Stanford

(57) ABSTRACT

A water flow limiting system for a boat including a water flow limiting plate, a coupling mechanism and a controllable bite ram. The water flow limiting plate is positioned below the propeller shaft and forward of the propeller for limiting water flow to the propeller. The coupling mechanism is provided for steering the water flow limiting plate relative to the boat. The coupling mechanism may be a mounting mechanism which maintains the flow limiting plate generally aligned with the propeller shaft, or it may be a steering mechanism which steers the flow limiting plate relative to the propeller shaft. The controllable bite ram controls vertical displacement of the flow limiting plate relative to the propeller shaft. A propeller guard system positioned above the water flow limiting plate may be included. A cooling coil may be affixed to the water flow limiting plate.

16 Claims, 10 Drawing Sheets

WATER FLOW LIMITING SYSTEM FOR A BOAT INCLUDING A WATER FLOW LIMITING PLATE POSITIONED RELATIVE TO PROPELLER SHAFT AND PROPELLER OF A BOAT FOR LIMITING WATER FLOW TO THE PROPELLER

CROSS-REFERENCE TO RELATED APPLICATIONS

This application claims the benefit of U.S. Provisional Application Ser. No. 61/117,662, filed on Nov. 25, 2008, which is herein incorporated by reference for all intents and purposes.

BACKGROUND OF THE INVENTION

1. Field of the Invention

The present invention relates to boating, and more specifically to a controllable plate of an effective area that limits and controls the flow of water upward into a propeller.

2. Description of the Related Art

Various means exist for controlling the flow of water into a propeller. Most of this prior art is for fully submerged propellers and is not suitable for surface piercing propellers. Von Wolske U.S. Pat. No. 6,823,812 uses trim tabs on a boat with a surface piercing propeller wherein such tabs are affixed to the boat as part of an extension to the bottom surface of the boat and are used for drastically changing the flight attitude of the boat. The propeller is steered relative to the plate. Arneson U.S. Pat. No. 4,645,463 has a trim fin located on the bottom of the propeller skeg and operates below water, "—trim fin below water level about 12 inches and provides downward lift." Arneson U.S. Pat. No. 4,544,362 has a plate above the propeller shaft. Evinrude U.S. Pat. No. 4,096,819 has a plate fully submerged. Buzzi U.S. Pat. No. 6,464,549 has a "ground wall" that limits the upward flow of water into a propeller but it is not controllable and it is fastened to the hull bottom.

BRIEF DESCRIPTION OF THE DRAWINGS

The benefits, features, and advantages of the present invention will become better understood with regard to the following description, and accompanying drawings, in which:

FIG. 2 shows the plate and a propeller affixed to a propeller shaft located above the plate.

FIG. 3 shows the plate and a propeller affixed to a propeller shaft located above the plate.

DETAILED DESCRIPTION

Figure 1:
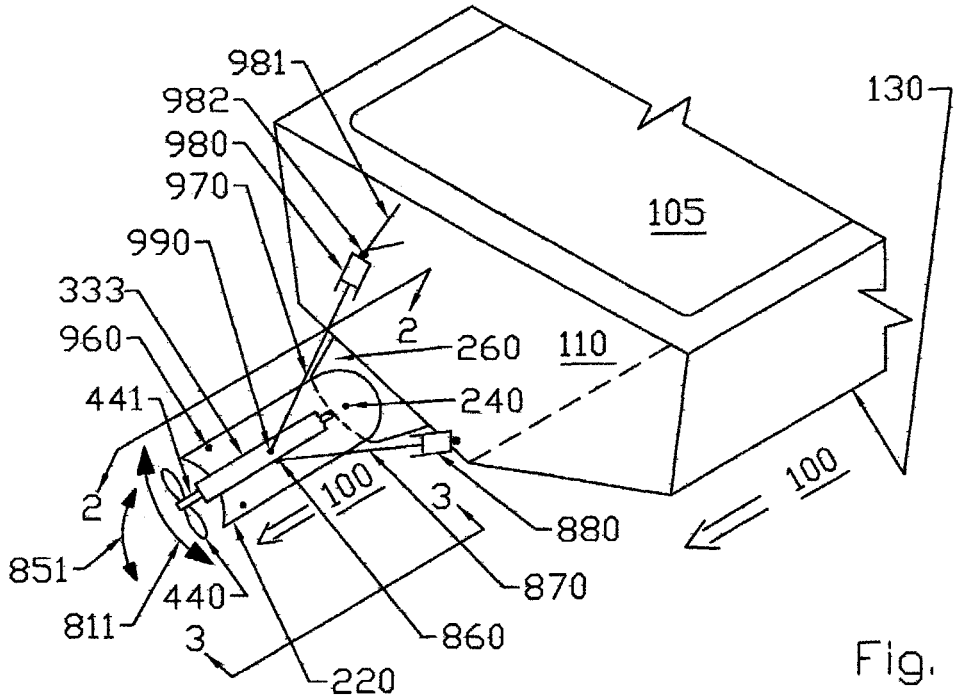
FIG. 1 is a perspective view of a portion of the rear end of a boat with a transom as viewed from above and off the right side of the boat. The boat has a surface piercing propeller mounted on a propeller shaft located above a plate that limits the upward flow of water into the propeller. Means for steering and raising the propeller are included.

The following description is presented to enable one of ordinary skill in the art to make and use a plate to limit the upward flow of water into a propeller according the present invention as provided within the context of a particular application and its requirements. Various modifications to the preferred embodiment will, however, be apparent to one skilled in the art, and the general principles defined herein may be applied to other embodiments. Therefore, a system and method according to the present invention is not intended to be limited to the particular embodiments as shown and described herein, but is to be accorded the widest scope consistent with the principles and novel features herein disclosed.

It is desired to limit the flow of water upward into a propeller, to provide a steerable trim tab, to provide a propeller guard to limit injuries to swimmers from blade strikes, and to provide a propeller shield to limit damage to propeller blades from hitting solid objects.

The present disclosure describes a controllable plate of an effective area that limits and controls the flow of water upward into a propeller. The plate acts like a short water ski running in front of, and below, the propeller shaft to control how much water can flow up into the spinning blades of the propeller. A specific use of the present invention is for boats that are planing on the surface of the water and that have a surface piercing propeller, or a super cavitating propeller, wherein the rotating blades pierce the surface of the water when the boat is running at high speed. One embodiment allows for a flow limiting, steerable plate to move with the propeller shaft as the boat changes direction during steering actions. The present invention is suitable for extended shaft surface drives, outboard motors, and inboard/outboard drives. It is useful for controlling the flow of water reaching the propeller on surface piercing propellers. It has some of the characteristics of a trim tab.

According to one embodiment described herein, a plate located to limit the upward flow of water into a propeller includes a means to position a plate in an alignment generally parallel to the undersurface of a boat and under a propeller shaft and forward of the propeller affixed to the propeller shaft. According to one embodiment, the plate has a width that is approximately the same as the diameter of the propeller. This is considerably different from prior art that has a very wide trim tab often several times the width of the propeller diameter and wherein the trim tab is affixed to the boat hull. The plate is generally slightly less in length than the distance between the propeller and the transom located forward thereof, although it can be considerably shorter depending on operating conditions. According to one embodiment, the plate is attached to the propeller shaft carrier and is not connected to the boat hull. In another embodiment, the plate is attached to the propeller shaft carrier and to the boat hull. In another embodiment the plate is constrained to maintain the forward end of the plate above the bottom of the boat. In another embodiment, the plate is allowed to pivot about a point close to the transom to allow the propeller shaft to sweep left and right in a steering motion.

A prior art means is provided to cause the propeller shaft to sweep generally to the left and to the right in accordance with a steering command from the boat operator. One embodiment of present invention includes a novel means to control the perpendicular distance of the plate below the propeller shaft. Another control means is provided to control the up and down position of the propeller shaft, hence the propeller, relative to the bottom of the boat. In one embodiment, a retractable skeg is added to the plate to supplement a skeg on the propulsion means. In one embodiment, a propeller guard is added to the plate to prevent propeller strike injuries to swimmers or marine mammals. In one embodiment, a cooling coil is added to the plate to provide a version of a keel cooler for providing a heat transfer surface to cool liquids from the boat.

FIG. 1 is a perspective view of a portion of the rear end of a boat 105 with a transom 110 as viewed from above and off the right side of the boat. The boat has a surface piercing propeller 440 mounted on the rearward end of propeller shaft 441 that is journaled inside a propeller shaft carrier 333 and located above a plate 220 that limits the upward flow of water 100 into the propeller. Means for steering include steering ram 880 and steering ram piston rod 870. Means for raising the propeller include tilt ram 980 and tilt ram piston rod 970. The boat bottom 130 is that surface that floats or rides over the water 100. Although all boats have a hull of finite thickness, it is the exterior surface of the bottom that interacts with the water and it is that surface that defines the shape of the water surface located behind the boat when at planing speeds. In this discussion, the boat bottom includes both the left and right side of the boat but the indicator arrow is directed to only one side to minimize clutter on the drawings. The transom 110 is shown as a large flat area, but it can be a relatively small area that has the characteristic of being generally vertical and has a lower edge where the flowing water 100 tends to separate from the vertical surface when the boat is moving at faster than planing speed. Some modern boats have multiple areas that can be considered as a transom or as a portion of a transom and therefore suitable for present invention. FIG. 1 shows a "V" bottom hull with a single propeller on one side of the boat, but it is anticipated that another propeller system would be installed to make the boat symmetric. Present invention is suitable for boats with flat bottoms, or even multiple hulls, for example, catamarans that have two hulls. Present invention is also suitable for boats with a single propeller drive and would usually be placed along the centerline of the boat in alignment with the keel. Present invention contemplates that the plate 220 may be flat, or may be "V" shaped, or may be cupped to follow the curvature of the radius of the propeller blade path.

Figure 2:
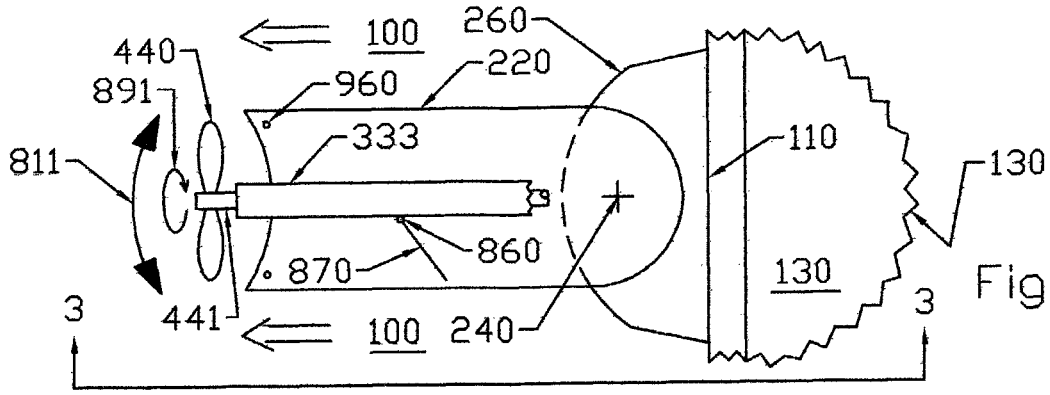
FIG. 2 is a top view of a limited portion of FIG. 1 as indicated by Section Line 2 in FIG. 1.

FIG. 2 is a top view of a limited portion of FIG. 1 as indicated by Section Line 2 in FIG. 1. FIG. 2 shows the plate 220 and a propeller 440 affixed to a propeller shaft 441 journaled inside a propeller shaft carrier 333 and located above the plate. A fragment of the boat shows the boat bottom 130 and transom 110 and a pivot bracket 260 mounted to the transom. There is a pivot pin 240 that serves as a center of swing for the steering motion 811 of the propeller and plate sweep as depicted by the heavy curved vector rearward of the propeller. The exact nature of the propeller shaft carrier 333 is intentionally left ambiguous because present invention will work with several types of propulsors including extended shaft types, outboard motors, and inboard/outboard drives all depicted in later Figures.

Figure 3:
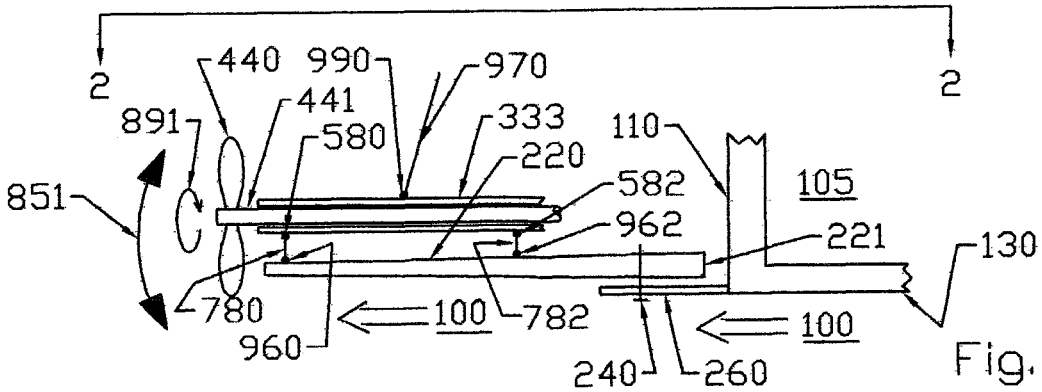
FIG. 3 is a side view of a limited portion of FIG. 1 as indicated by Section Line 3 in FIG. 1.

FIG. 3 is a side view of a limited portion of FIG. 1 as indicated by Section Line 3 in FIG. 1. FIG. 3 shows the plate 220 and a propeller 440 affixed to a propeller shaft 441 and journaled inside a propeller shaft carrier 333 located above the plate. A fragment of the boat 105 shows the boat bottom 130 and the transom 110. Water 100 is shown as a double vector moving past the underside of the boat bottom and across the underside of the pivot bracket 260 to continue along the undersurface of the plate 220 and into the path of the tips of the blades of the propeller 440. The plate may be of uniform thickness or tapered in thickness along the length as shown or may be tapered or straight in width as desired. Plate 220 is secured to the transom by pivot bracket 260 and pivot pin 240. A bite control 780 means for controlling the depth of the propeller blade tips below the plate is located near the rearward end of the propeller shaft carrier. A second vertical spacer 782 is located nearer to the forward end of the plate.

Figure 4:
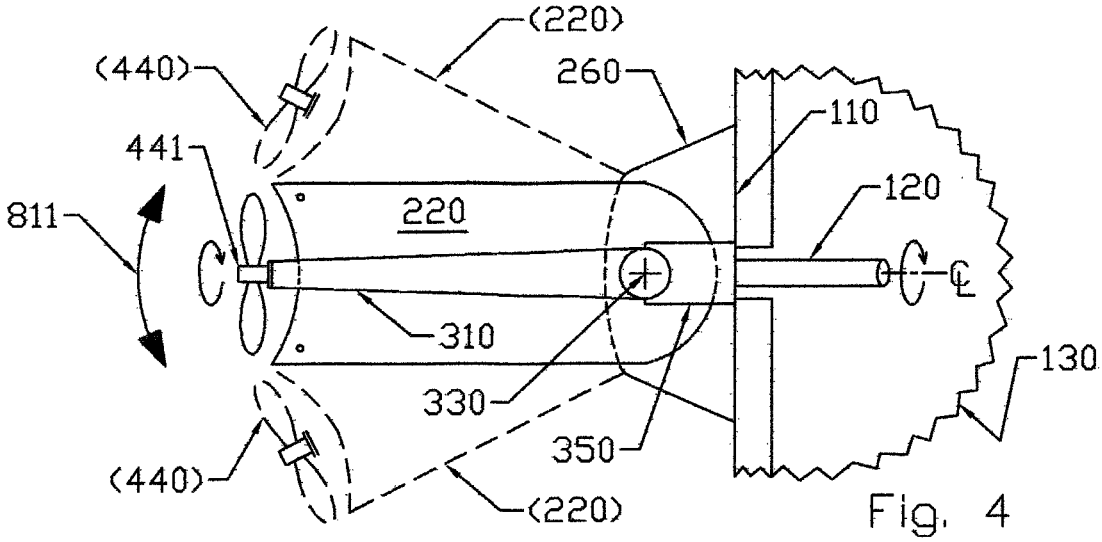
FIG. 4 is a top view similar to FIG. 2 but shows the propeller shaft and plate swinging left and right in a steering motion and are depicted as dashed lines.

FIG. 4 is a top view similar to FIG. 2 but shows the propeller shaft 441 and plate 220 swinging left and right in a steering motion 811 and are depicted as dashed lines. The propulsor is an extended shaft style and has a drive shaft 120 turned by a motor, not shown, and an articulation joint 330 with a center that is located approximately above the pivot pin 240 of FIG. 2 and FIG. 3. In one embodiment, the plate is mounted to the extended shaft propeller shaft carrier 310 at two locations and the pivot plate 260 is not constrained to the plate by the pivot pin 240 in order to prevent the swing action from being over constrained. In another embodiment, the plate is mounted to the extended shaft propeller shaft carrier at only one location and the pivot pin is necessary to define and constrain the swing motion of the plate in harmony with the propeller shaft steering motion. Either embodiment will suffice to maintain the plate in directional harmony with the propeller shaft while still allowing the propeller bite to be controlled independently by a mechanism similar to bite control 780 of FIG. 3.

Figure 5:
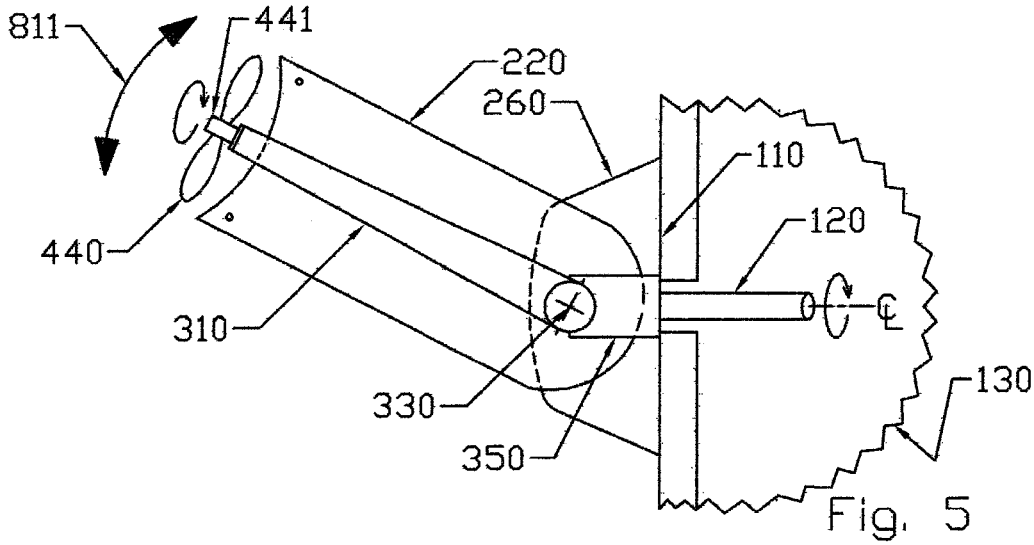
FIG. 5 is a top view similar to FIG. 4 and shows the plate and propeller steered toward the left side of the boat.

FIG. 5 is a top view similar to FIG. 4 and shows the plate 220 and propeller 440 steered toward the left side of the boat.

Figure 6:
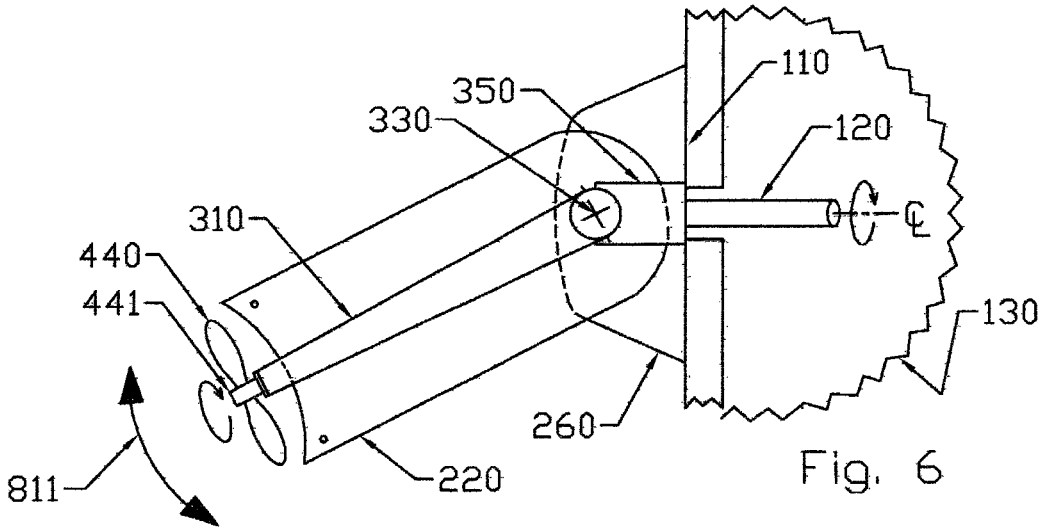
FIG. 6 is a top view similar to FIG. 4 and shows the plate and propeller steered toward the right side of the boat.

FIG. 6 is a top view similar to FIG. 4 and shows the plate 220 and propeller 440 steered toward the right side of the boat.

Figure 7:
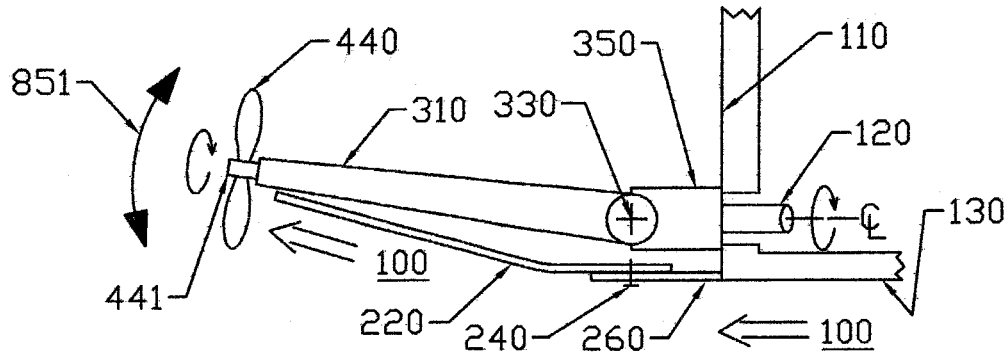
FIG. 7 is a side view similar to FIG. 3 and shows the propeller and plate lifted to the fully up position.

FIG. 7 is a side view similar to FIG. 3 and shows the propeller 440 and plate 220 lifted to the fully up position. Refer to FIG. 1 to see how tilt ram bracket 981 is connected to tilt ram 980 and in turn to tilt ram piston rod 970 is connected to propeller shaft carrier 310 to raise the propeller shaft 441 and propeller 440. A bite control 780, see FIG. 3, is contracted to its shortest length to pull the plate up closest to the propeller shaft carrier for maximum propeller bite while simultaneously allowing the propeller to generate a downward thrust vector component to generate a moment arm on the stern of the boat and cause the front of the boat to trim to an up attitude. This upward position of the plate tends to add positive curvature to the planing surface to further cause the front of the boat to rise.

Figure 8:
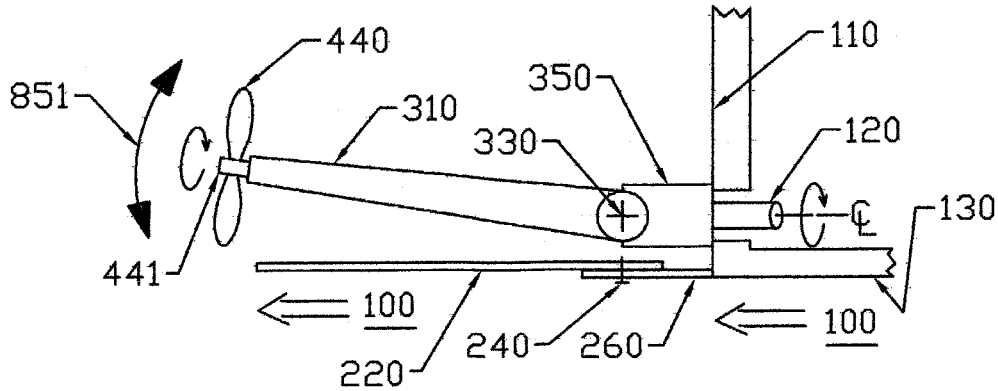
FIG. 8 is a side view similar to FIG. 3 and shows the propeller in the up position and the plate in the neutral position.

FIG. 8 is a side view similar to FIG. 7 and shows the propeller 440 raised to the up position and the plate 220 in the neutral position. Again, as in FIG. 7, refer to FIG. 1 to apply the same mechanism to control the vertical positions of the propeller and plate. In this configuration, the plate is in a neutral position and the propeller is raised above the plate. Under these conditions the propeller has very little effective bite in the water 100 unless the boat is going very slow and the water velocity is so low that it can well up around the plate to enter the blades of the propeller. This would be a suitable operation in shallow water or when around swimmers to prevent those objects from receiving propeller strikes. In this configuration and with the boat at trolling speed, the propeller is generating a downward force on the transom 110 and often will cause the front of the boat to ride at an undesirably high attitude.

Figure 9:
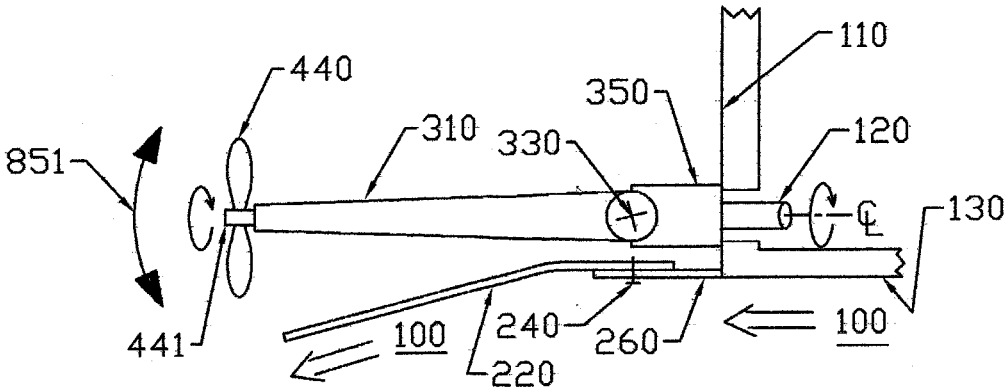
FIG. 9 is a side view similar to FIG. 3 and shows the propeller in the neutral position and the plate in the down position.

FIG. 9 is a side view similar to FIG. 8 and shows the propeller 440 in the neutral position and the plate 220 in the down position. Under the same operating speed conditions as FIG. 8, the propeller thrust does not push down on the transom 110 to cause the undesirable front raised attitude, and the plate 220 tends to raise the rear end of the boat to further bring the attitude of the front of the boat down for the convenience and safety of the boat passengers.

Figure 10:
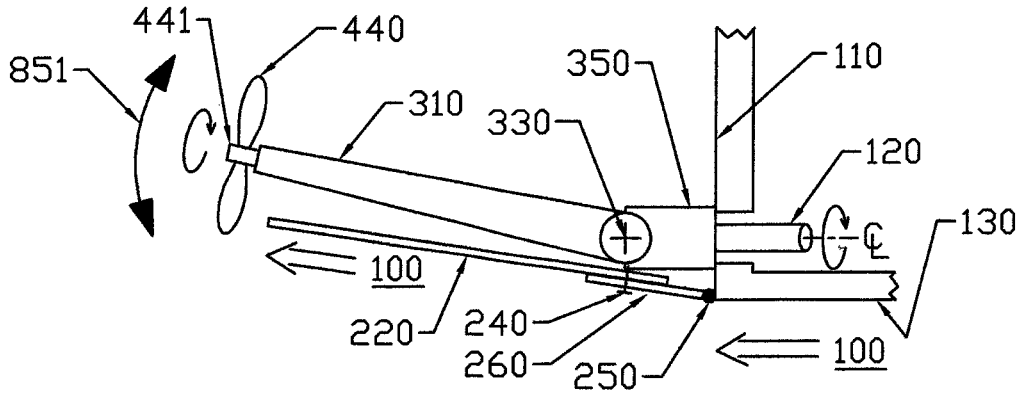
FIG. 10 is a side view similar to FIG. 3 and shows the propeller in the up position and the plate in an up position and is hinged to the transom.

FIG. 10 is a side view similar to FIG. 7 and shows the propeller 440 in the up position and the plate 220 in a moderate up position. In this position, the propeller has a moderate amount of bite on the water 100 and also exerts a downward force on the transom 110 to raise the front of the boat while at planing speed. Note that pivot bracket 260 is secured to transom 110 by hinge 250.

Figure 11:
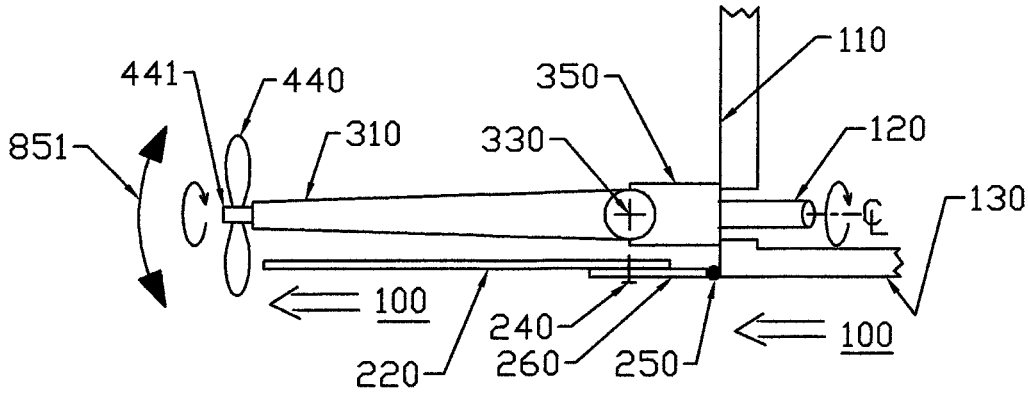
FIG. 11 is a side view similar to FIG. 3 and shows the propeller in a neutral position and the plate in a neutral position and is hinged to the transom.

FIG. 11 is a side view similar to FIG. 8 and shows the propeller 440 in a neutral position and the plate 220 in a neutral position. In this position, the propeller has moderate amount of bite on the water 100 but does not exert any vertical force on the transom 110 to either raise or lower the front of the boat while at planing speed. Note that pivot bracket 260 is secured to transom 110 by hinge 250.

Figure 12:
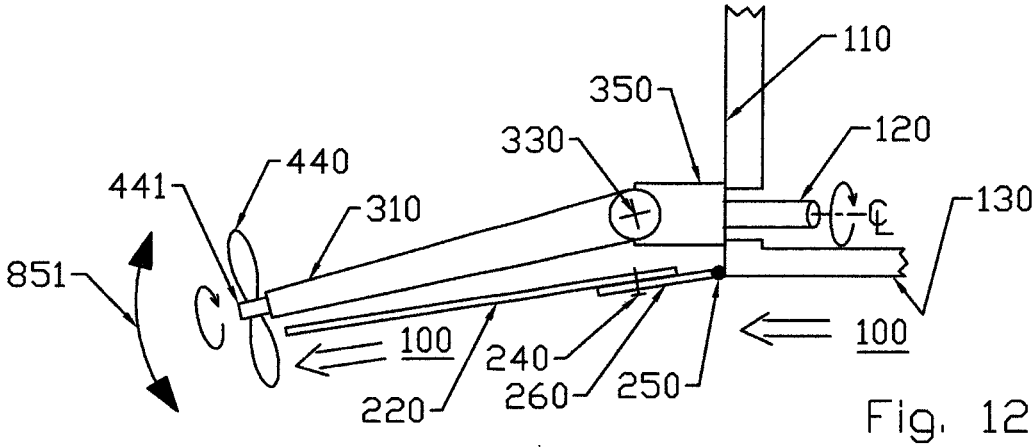
FIG. 12 is a side view similar to FIG. 3 and shows the propeller in the fully down position and the plate in a down position and is hinged to the transom.

FIG. 12 is a side view similar to FIG. 9 and shows the propeller 440 in the fully down position and the plate 220 in a down position. In this position, the propeller has moderate amount of bite on the water 100 and exerts an upward force on the transom 110 to force the front of the boat down while at planing speed. Note that pivot bracket 260 is secured to transom 110 by hinge 250.

Figure 13:
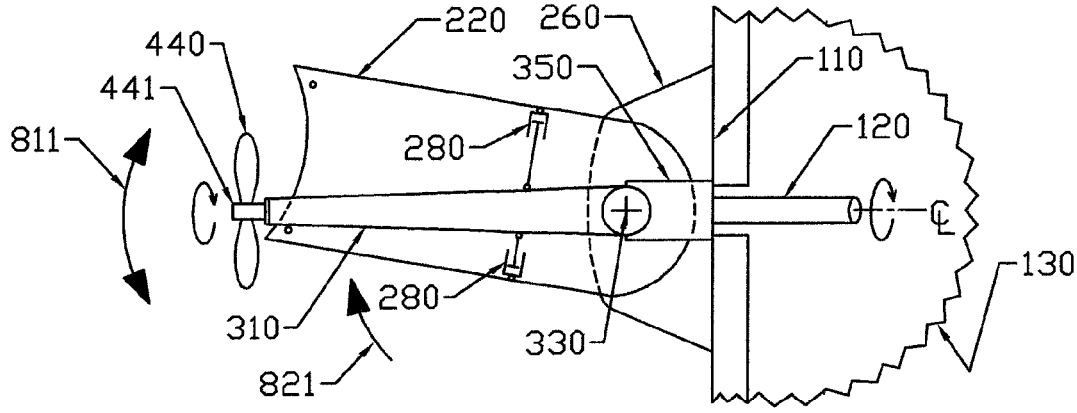
FIG. 13 is a top view similar to FIG. 2 and shows the propeller in the straight back position and the plate shifted off to the left of the propeller shaft. The mechanism for shifting the plate off to the side of the propeller is also shown.

FIG. 13 is a top view similar to FIG. 2 and shows the propeller 440 in the straight back position and the plate 220 shifted off to the left of the propeller shaft 441. The mechanism for shifting the plate off to the side of the propeller is also shown as a pair of opposed side shift rams 280. This embodiment allows more water to flood upward into the propeller.

Figure 14:
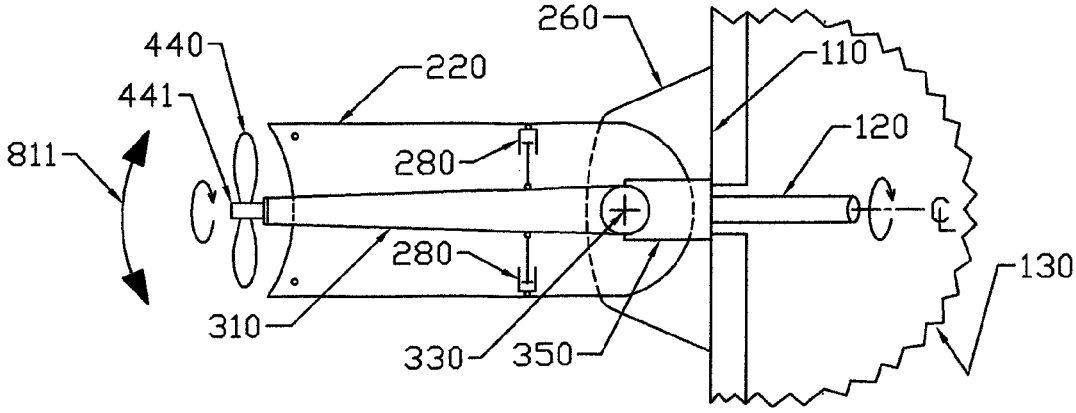
FIG. 14 is a top view similar to FIG. 2 and shows the propeller shaft in the straight back position and the plate centered below the propeller shaft. The mechanism for shifting the plate off to the side of the propeller is also shown.

FIG. 14 is a top view similar to FIG. 2 and shows the propeller 440 in the straight back position and the plate 220 centered below the propeller shaft 441. The mechanism for shifting the plate off to the side of the propeller is also shown as a pair of opposed side shift rams 280. This embodiment allows more water to flood upward into the propeller when desired.

Figure 15:
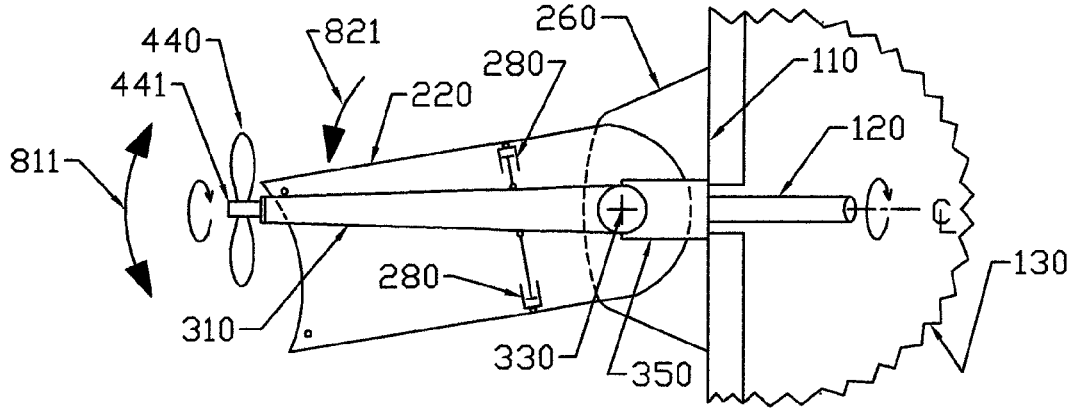
FIG. 15 is a top view similar to FIG. 2 and shows the propeller shaft in the straight back position and the plate shifted off to the right of the propeller shaft. The mechanism for shifting the plate off to the side of the propeller is also shown.

FIG. 15 is a top view similar to FIG. 2 and shows the propeller 440 in the straight back position and the plate 220 shifted off to the right of the propeller shaft 441. The mechanism for shifting the plate off to the side of the propeller is also shown as a pair of opposed side shift rams 280. This embodiment allows more water to flood upward into the propeller. It is noted that the preferred shift direction will depend upon which direction that the propeller is rotating to maximize the lifting effect of the propeller.

Figure 16:
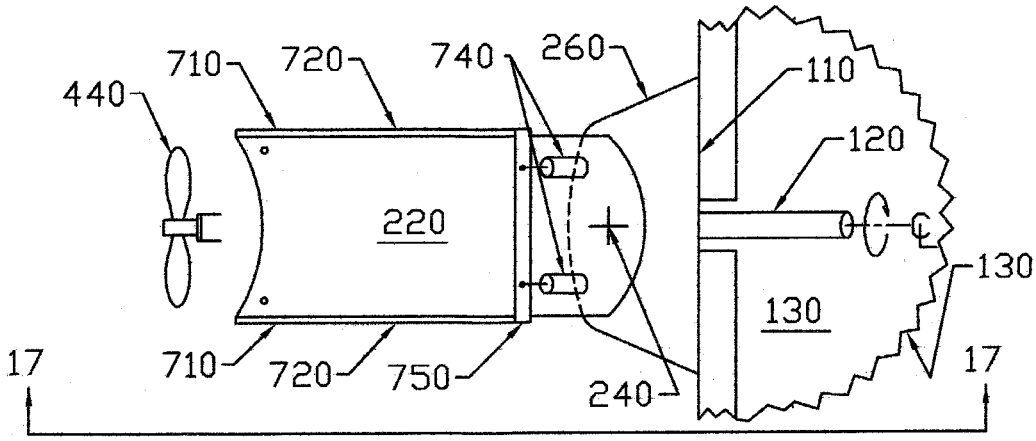
FIG. 16 is a top view similar to FIG. 2 and shows a retractable skeg mechanism.

FIG. 16 is a top view similar to FIG. 2 and shows a retractable skeg mechanism. The skegs 710 are located along the edges of the plate 220 and each skeg is one of a pair of skegs that are mounted on the rearward ends of skeg legs 720 that are connected to skeg leg hinge 750 that are secured to plate 220. The skeg legs are raised by a force pulling on skeg arms 730, connected to skeg rams 740, attached to plate 220. Any of several skeg rams can be used including hydraulic cylinders and pistons, or electric jackscrews. Skegs in a fixed position are well known art and are used to guide and protect a propeller. Skegs are generally a fin that cuts through the water.

Figure 17:
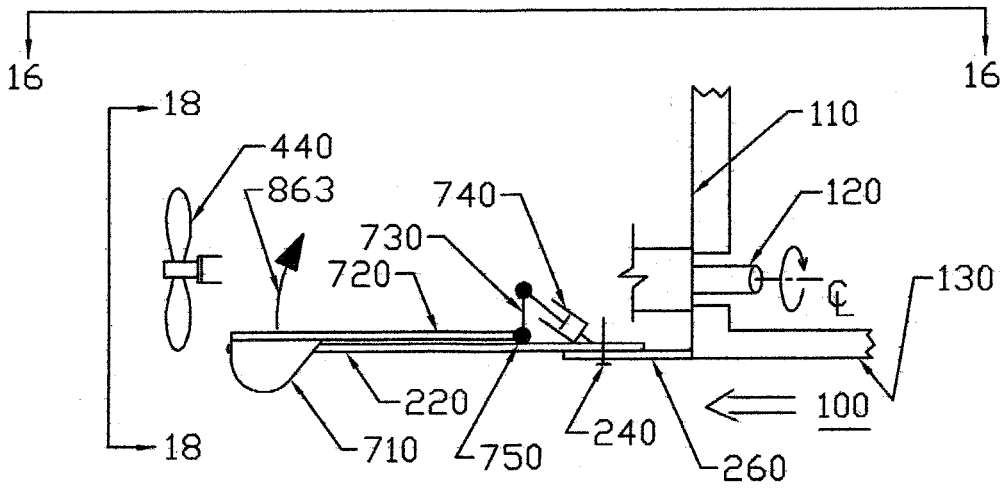
FIG. 17 is a side view taken along Section Line 17 of FIG. 16 and shows the retractable skeg mechanism.

FIG. 17 is a side view taken along Section Line 17 of FIG. 16 and shows the retractable skeg mechanism. The same explanation as in FIG. 16 applies to FIG. 17 wherein the skeg rams 740 are used to pull the skegs 710 upward along the skeg path 863 and out of the water 100.

Figure 18:
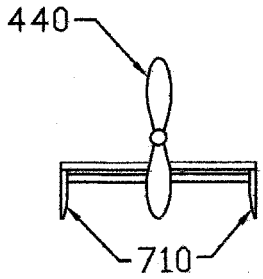
FIG. 18 is a rear end view as taken along Section Line 18 of FIG. 17 and shows the two skegs protruding downward from the plate.

FIG. 18 is a rear end view as taken along Section Line 18 of FIG. 17 and shows the two skegs 710 relative to propeller 440.

Figure 19:
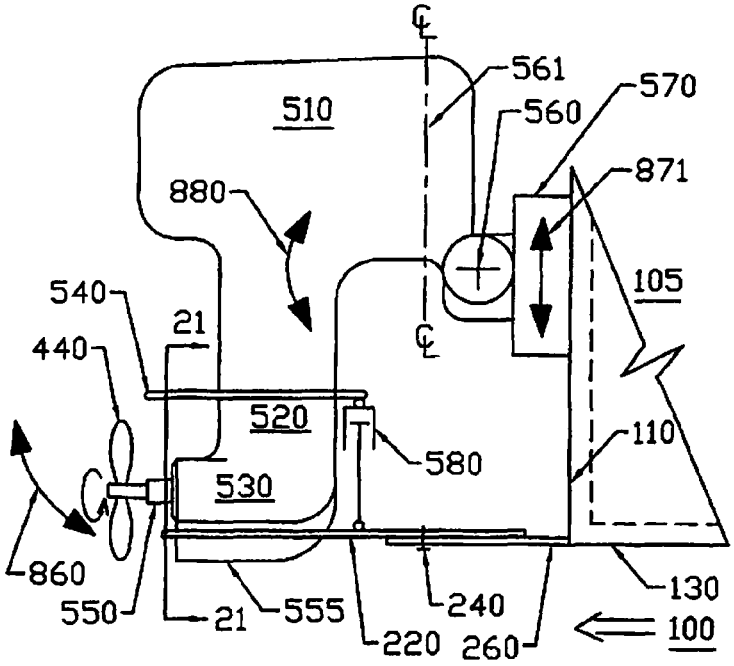
FIG. 19 is a side view of the plate and the rear end of the boat having an outboard motor, including a propeller, mounted to the transom of the boat.

FIG. 19 is a side view of plate 220 and the rear end of boat 105 showing transom 110 having an outboard motor 510, including propeller shaft carrier 530, propeller shaft 550, and propeller 440, mounted to the transom 110 of the boat. The propeller shaft carrier is often referred to as a gear case in the language of outboard motor technology. The outboard motor is a commercially available unit well known in the industry as it combines a motor together with appropriate gearing and a propeller. The outboard motor is mounted to the boat by means of a commonly known, but optional jack plate 570 that allows the motor to be adjusted vertically as shown by a dark vertical vector arrow 871, to vary the depth of propeller immersion into the water 100. The outboard motor also has the customary tilt axis 560, that allows the entire unit to be tilted to cause the propeller to follow a path as shown by the dark curved vector 860 located adjacent to the propeller. Propeller immersion can be adjusted at the will of the boat operator by use of the tilt controls and the jack plate controls. Plate 220 limits sporadic variations in the depth of propeller immersion due to the boat bounce and waves carried across the boat bottom 130. Plate 220 is connected to the outboard motor by means of a bite ram 580 and is controllable by the boat operator to control the depth of immersion, or bite, of the propeller into the water. The plate also limits spurious variations of propeller bite into the water. These spurious variations happen when the boat is traveling at high speed and the waves carry under the boat bottom 130, or when the boat is bouncing, or when the boat is accelerating from a slow speed to a high speed wherein the boat has a natural tendency to squat down in the rear as the front of the boat tends to rise. Plate 220 is connected via pivot pin 240 to plate bracket 260 that is connected to transom 110. It is not essential that plate bracket 260 exist. However, it is necessary that the front edge of the plate not dip below the elevation of the bottom of the boat at high speeds because it could be torn loose from the propeller shaft carrier 530. The use of pivot pin 240 could be deleted if plate 220 is held upward above boat bottom 130 by other means, for example a second mechanism similar to bite ram 580 or by means of a tether connected to the transom to keep the forward end of the plate above the elevation of the boat bottom. Bite ram 580 may be connected to the propeller shaft carrier via cavitation plate 540 or other convenient bracket spatially related to the propeller shaft carrier. Skeg 555 descends downward through a slot in plate 220. The skeg is optional on the propulsion system.

Figure 20:
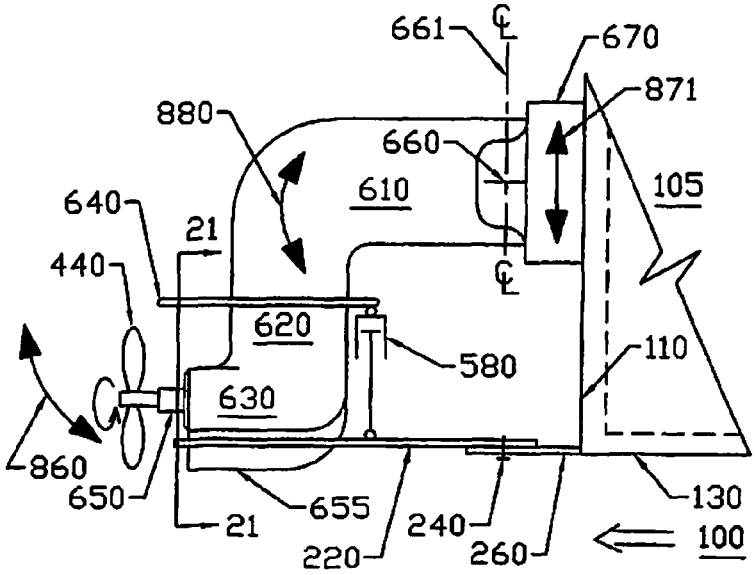
FIG. 20 is a side view of the rear end of the boat similar to FIG. 19 and shows an inboard/outboard drive unit mounted to the transom of the boat.

FIG. 20 is a side view of plate 220 and the rear end of boat 105 showing transom 110 having an inboard/outboard drive 610, including propeller shaft carrier 630, propeller shaft 650, and propeller 440, mounted to transom 110 of the boat. The explanation for the inboard/outboard drive is nearly identical to that of the outboard motor system, except there are slightly different names associated with each art. The propeller shaft carrier is often referred to as a gear case in the language of boat technology. The inboard/outboard drive is a commercially available unit well known in the industry and includes a system with appropriate gearing and a propeller. The inboard/outboard drive is mounted to the boat by means of a commonly known, but optional jack box 670 that allows the drive to be adjusted vertically as shown by a dark vertical vector arrow 871, to vary the depth of propeller immersion into the water 100. The inboard/outboard drive also has the customary tilt axis 660, that allows the entire unit to be tilted to cause the propeller to follow a path as shown by the dark curved vector 860 located adjacent to the propeller. Propeller immersion can be adjusted at the will of the boat operator by use of the tilt controls and the jack box controls. Plate 220 limits sporadic variations in the depth of propeller immersion due to the boat bounce and waves carried across the boat bottom 130. Plate 220 is connected to the inboard/outboard drive by means of a bite ram 580 and is controllable by the boat operator to control the depth of immersion, or bite, of the propeller into the water. The plate also limits spurious variations of propeller bite into the water. These spurious variations happen when the boat is traveling at high speed and the waves carry under the boat bottom 130, or when the boat is bouncing, or when the boat is accelerating from a slow speed to a high speed wherein the boat has a natural tendency to squat down in the rear as the front of the boat tends to rise. Plate 220 is connected via pivot pin 240 to plate bracket 260 that is connected to transom 110. It is not essential that plate bracket 260 exist. However, it is necessary that the front edge of the plate not dip below the elevation of the bottom of the boat at high speeds because it could be torn loose from the propeller shaft carrier 630. The use of pivot pin 240 could be deleted if plate 220 is held upward above boat bottom 130 by other means, for example a second mechanism similar to bite ram 580 or by means of a tether connected to the transom to keep the forward end of the plate above the elevation of the boat bottom. Bite ram 580 may be connected to the propeller shaft carrier via cavitation plate 640 or other convenient bracket spatially related to the propeller shaft carrier. Skeg 655 descends downward through a slot in plate 220. The skeg is optional on the propulsion system.

Figure 21:
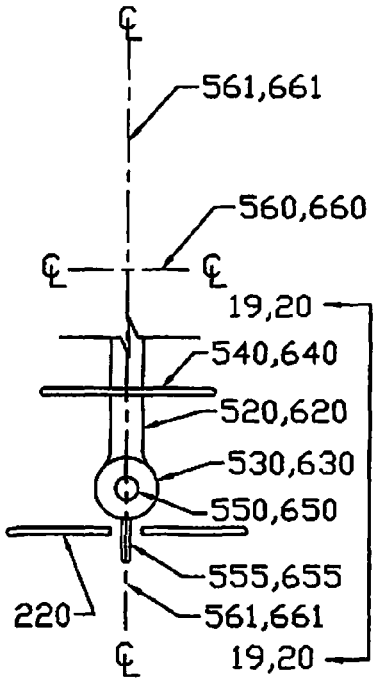
FIG. 21 is a rear end view of a portion of the lower unit of an outboard motor or inboard/outboard drive as shown by Section Line 21 of FIG. 19 and FIG. 20.

FIG. 21 is a rear end view of a portion of the lower unit of an outboard motor 520 or inboard/outboard drive 620 as shown by Section Line 21 of FIG. 19 and FIG. 20. Skeg 555, 655 of either propulsion system descends downward through a slot in plate 220. The skeg in the slot helps to constrain the side-to-side position of propeller shaft 550, 650 relative to plate 220.

Figure 22:
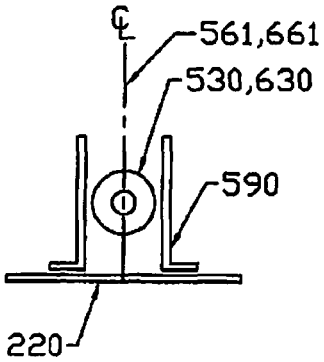
FIG. 22 is a rear end view of a portion of the lower unit of an outboard motor or inboard/outboard motor that has no skeg on the gear case and is maintained in alignment relative to the plate by a pair of guide brackets.

FIG. 22 is similar to FIG. 21 and shows a rear end view of a portion of the lower unit of an outboard motor or inboard/outboard drive that has no skeg on the gear case 530, 630 and wherein side to side alignment relative to plate 220 is maintained by a pair of side guide brackets 590.

Figure 23:
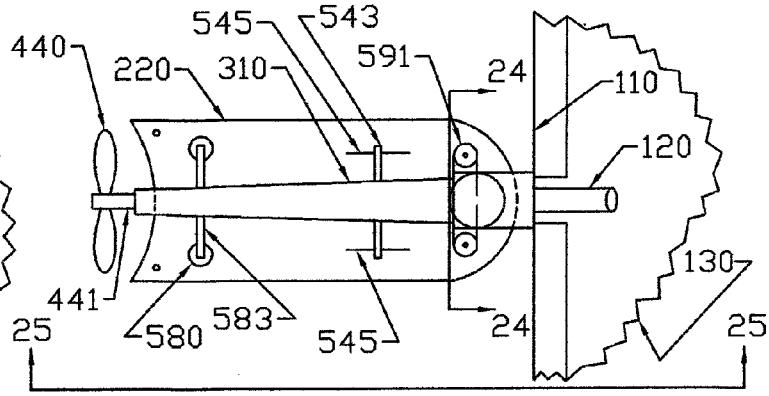
FIG. 23 is a top view similar to FIG. 2 and shows a means to hold the plate in alignment relative to the propeller shaft.

FIG. 23 is a view similar to FIG. 2 showing the top view of a means used to hold propeller shaft 441 horizontally separated from plate 220. This figure represents an extended shaft type surface drive propulsion system. Located on the rearward end of plate 220 is a bite ram 580 on each end of a bite bar 583 attached to propeller shaft carrier 310. Located on the forward end of plate 220 is a stand off bar 543 attached to, and directed outwardly from the propeller shaft carrier and includes stand off bar chairs 545 that act together to maintain a given vertical space between the forward end of the plate and the propeller shaft carrier.

Figure 24:
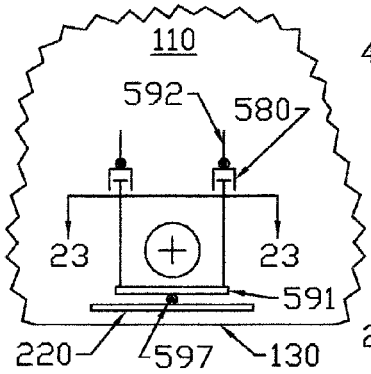
FIG. 24 is an end sectional view of the propeller shaft and plate as viewed along Section Line 24 of FIG. 23 and FIG. 25 and shows a means to hold the plate in position relative to the boat bottom.
Figure 25:
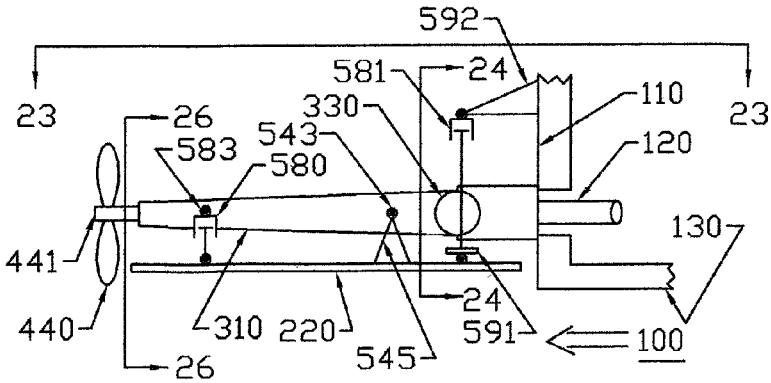
FIG. 25 is a side view of FIG. 23 as viewed along Section Line 25 of FIG. 23 showing the propeller, propeller shaft, and plate and means to hold the plate in position in relative to the propeller shaft.

FIG. 24 is an end sectional view of FIG. 23 and FIG. 25. This arrangement is different from FIG. 1, FIG. 2, and FIG. 3 because it uses an alternate method of maintaining the vertical position of plate 220 relative to the boat bottom 130 without the use of pivot bracket 260 and pivot pin 240 as depicted in FIG. 1, FIG. 2, and FIG. 3. This alternate method comprises a pair of transom brackets 592 mounted to the transom 110 on one end and connected to a pair of force rams 581 on the other end. The force rams connect to a crossbar 591 located above and connected to a pivot joint 597 that is in turn connected to plate 220. This loosely connected arrangement still maintains the vertical separation required while allowing the propeller to move up and down and left and right in a steering motion.

FIG. 25 is a side view of FIG. 23 as viewed along Section Line 25 of FIG. 23 showing the propeller 440, propeller shaft 441, and plate 220 and means to hold the plate in position relative to the propeller shaft. The rearward end of plate 220 is held below and in position relative to propeller shaft carrier 310 by means of bite ram 580 attached at its lower end to plate 220 and at its upper end to bite bar 583. Located on the forward end of plate 220 is a stand off bar 543 attached to, and directed outwardly from the propeller shaft carrier and includes stand off bar chairs 545 that act together to maintain a given vertical space between the forward end of the plate and the propeller shaft carrier. In this arrangement, pivot bracket 260 and pivot pin 240, as shown in FIG. 1, FIG. 2, and FIG. 3, may not be necessary providing that plate 220 does not drop below the elevation of the boat bottom 130 running in water 100. This loose relationship is depicted by the gap between the forward end of the plate and the rearward surface of transom 110.

Figure 26:
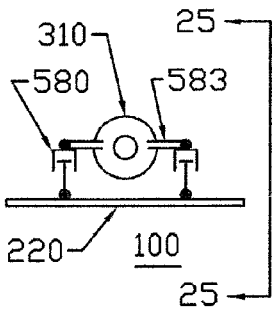
FIG. 26 is an end sectional view of FIG. 25 as viewed along Section Line 26 of FIG. 25 showing the propeller shaft and plate including a means to control the vertical distance of the plate below the propeller shaft.

FIG. 26 is an end view along Section Line 26 of FIG. 25 and shows propeller shaft carrier 310 and plate 220 and further clarifies the function of the bite rams 580 attached at the upper end to bite bar 583 that in turn are attached to the propeller shaft carrier and bite rams attached to the plate. Means to control the vertical space between the propeller shaft carrier and the plate can be done by remote control by the boat operator. Bite ram 580 may be a hydraulic cylinder and piston combination or may be an electric screw means.

Figure 27:
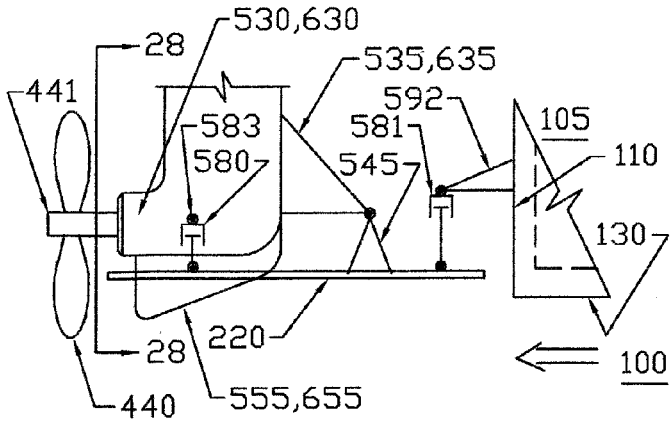
FIG. 27 is a side view of a portion of a lower unit of an outboard motor or inboard/outboard drive including propeller and plate.

FIG. 27 is a side view of a portion of a lower unit of an outboard motor or inboard/outboard drive and shows the gear case that serves as a propeller shaft carrier 530, 630 including propeller shaft 441, propeller 440 and plate 220, and means to hold the plate in position relative to the propeller shaft carrier. The rearward end of plate 220 is held below and in position relative to propeller shaft carrier 530, 630 by means of bite ram 580 attached at its lower end to plate 220 and at its upper end to bite bar 583. Located on the forward end of plate 220 is a stand off bracket 535, 635 attached to, and directed forwardly from the propeller shaft carrier and includes stand off bar chairs 545 that act together to maintain a given vertical space between the forward end of the plate and the propeller shaft carrier. This loose relationship is depicted by the gap between the rearward surface of transom 110 and the forward edge of plate 220. Skeg 555, 655 is shown descending through a slot in the plate. An alternate means for controlling the vertical separation of the forward end of the of the plate above the boat bottom uses transom bracket 592 connected to vertical ram 581 connected to plate 220.

Figure 28:
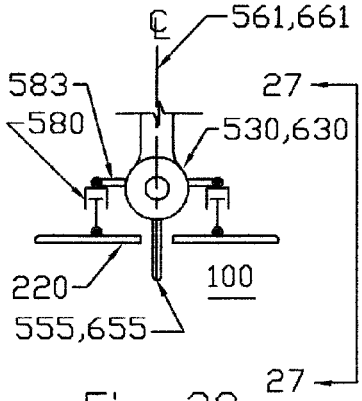
FIG. 28 is an end sectional view of FIG. 27 as viewed along Section Line 28 of FIG. 27 and shows a means to control the vertical distance of the plate below the propeller shaft.

FIG. 28 is an end view of FIG. 27 taken along Section Line 28 of FIG. 27 and shows the propeller shaft carrier 530, 630 and plate 220 including bite bar 583 and bite ram 580 to control the vertical separation of the plate below the propeller shaft carrier, hence the propeller shaft. Skeg 555, 655 is shown descending through a slot in the plate.

Figure 29:
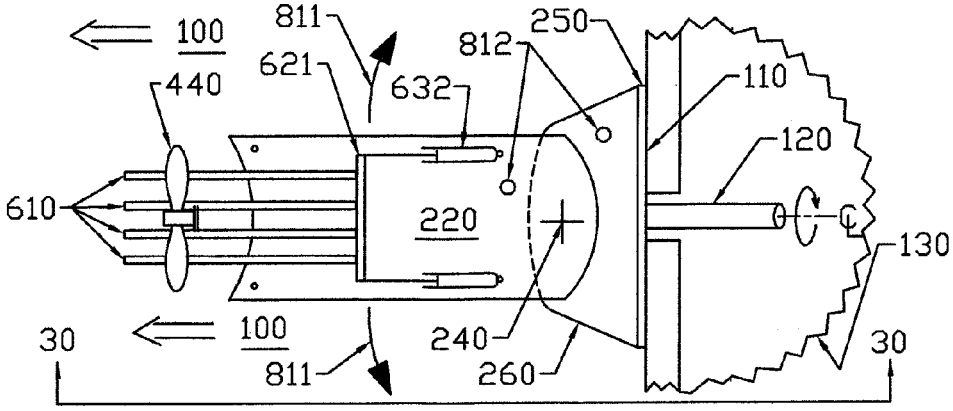
FIG. 29 is a top view similar to FIG. 2 showing an extendable propeller guard located above the plate and which extends rearward from the plate.

FIG. 29 is a top view similar to FIG. 2 showing extendable propeller guard tines 610 located above plate 220 and below propeller 440. Propeller guard tines 610 comprises a screen or grille like structure that prevents objects from rising up into the propeller blades and likewise prevents the propeller from descending down below the level of the plate. This propeller guard extends rearward from the plate by means of propeller guard rams 632 attached at one end to the plate and attached to the propeller guard frame 621 on the other end. This system allows propeller 440 to be raised up even while rotating while the guard tines are extended rearward to protect swimmers or marine mammals from propeller strikes and blade injuries. This feature is useful when the boat is traveling at trolling speeds because the water will still well up around the edges of the plate to fill the blades with water to give thrust to the boat. A plurality of coolant holes 812 are located on and through plate 220 or pivot bracket 250 to allow water 100 to be drawn up via a hose, not shown, into the boat as needed for cooling the engine or other components. Pivot bracket 260 may be connected to transom 110 by pivot bracket hinge 250 as similarly shown in FIG. 10.

Figure 30:
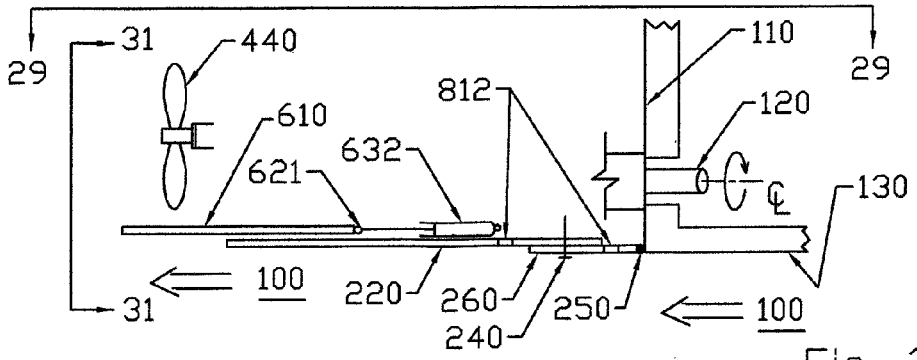
FIG. 30 is a side view of FIG. 29 as taken along Section Line 30 as shown in FIG. 29 and shows the propeller guard located above the plate but below the propeller.

FIG. 30 is a side view of FIG. 29 as taken along Section Line 30 as shown in FIG. 29 and shows propeller guard tines 610 located above plate 220 but below propeller 440. The propeller guard tines are shown in the extended position by means of guard rams 632 and serve as protection to swimmers and marine mammals. The guard rams can retract to pull the propeller guard tines forward to allow the propeller to descend to a position similar to that shown in FIG. 3. Coolant holes 812 are shown penetrating through plate 220 and through pivot bracket 260.

Figure 31:
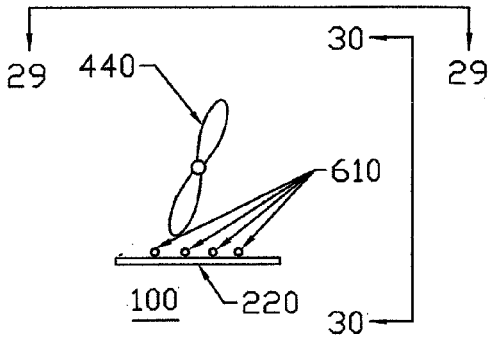
FIG. 31 is an end view of the propeller and plate as viewed along Section Line 31 of FIG. 30 and shows the end view of the propeller guard tines.

FIG. 31 is an end view of propeller 440 and plate 220 as viewed along Section Line 31 of FIG. 30 and shows the end view of propeller guard tines 610.

Figure 32:
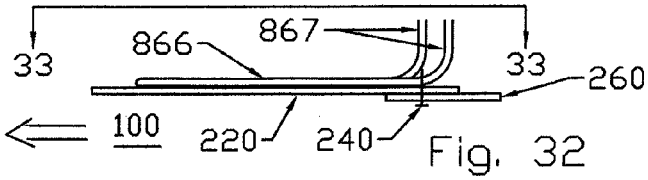
FIG. 32 is a side view of a plate with a cooling coil affixed to the plate.

FIG. 32 is a side view of a plate 220 with a cooling coil 866 affixed to plate 220 to serve as a type of heat exchanger between a hot fluid from the engine and the ambient temperature water 100. Cooling coil 866 is generally a serpentine section of metal tubing bonded to the upper surface of plate 220 and has coil connections 867 to accommodate fluid circulating hoses, not shown, between the engine and the cooling coil. This technology is generally known as "keel coolers" and is well known but has not been applied to trim tabs or the likes of present invention plate, because, traditional trim tabs spend a considerable amount of time out of the water and would be rather useless as a continuously effective heat transfer mechanism. In contrast, this embodiment of present invention is in contact with water at all times. At low speeds, the water floods over the top of the cooling coil. At high speeds the cooling coil transfers heat through the plate and into the rushing water below. It is relevant to note that prior art keel coolers were limited to surfaces or areas along the wetted bottom of the boat and are not used on auxiliary equipment such as present invention. Another problem with prior art keel coolers is that holes through the hull bottom were required to bolt the cooler to the boat bottom and other holes were required for the connections for the coolant fluid to pass through the hull. These necessary holes were a source of leakage into the dry portion of the hull.

Figure 33:
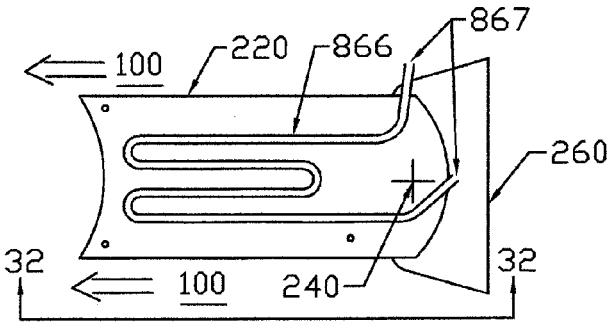
FIG. 33 is a top view of a plate including a cooling coil as viewed along Section Line 33 of FIG. 32.

FIG. 33 is a top view of plate 220 including cooling coil 866 and cooling coil connections 867 as viewed along Section Line 33 of FIG. 32. The serpentine routing of the coolant tube is shown to increase the residence time of the hot fluid in contact with the cold surface of plate 220. Other means of routing the fluid across the surface are possible and well known in the design of heat exchangers.

Figure 34:
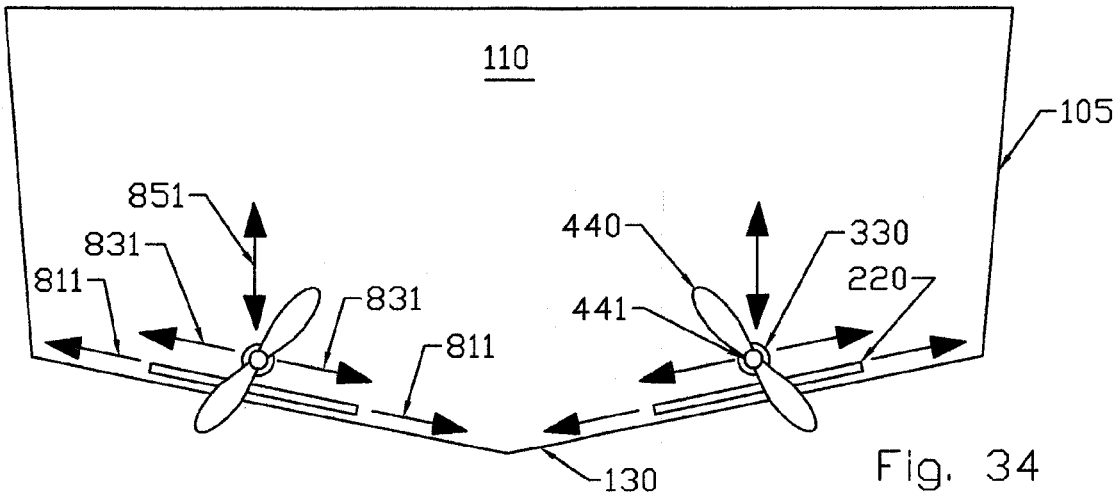
FIG. 34 is an end view of rear of a boat showing the transom and two propellers located on the left and right side of the boat respectively, and the associated plates located below the propeller shafts. The drawing also shows the up and down path of the propellers, the side to side motion of the propellers, and the side to side motion of the plates as heavy, dark line vectors.

FIG. 34 is an end view of rear of a boat 105 showing the transom 110 and two propellers 440 located on the left and right side of the boat respectively, and the plate 220 located below the propeller shaft 441. The drawing also shows the up and down path 851 of the propellers, the side to side motion 831 of the propellers, and the side to side motion 811 of the plates 220. This drawing depicts the motions of the components as heavy, dark line vectors that are typical of an extended shaft type of surface drive propulsion shown in FIG. 1.

Figure 35:
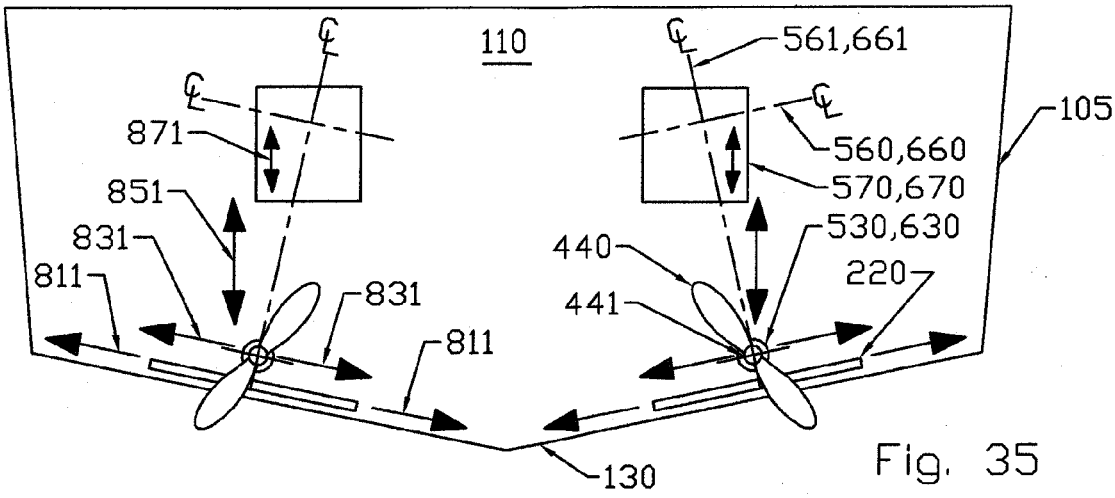
FIG. 35 is similar to FIG. 34 and is an end view of a similar boat using an outboard motor, or conversely, an inboard/outboard style propulsion, including a jack plate or a jack box respectively, mounted to the transom and used to raise and lower the propeller relative to the boat bottom and plate. The motion paths shown in FIG. 35 are similar to those shown in FIG. 34.

FIG. 35 is similar to FIG. 34 and is an end view of the rear of a similar boat 105 using an outboard motor, or conversely, an inboard/outboard style propulsion, including a jack plate 570 or a jack box 670 respectively, mounted to the transom 110 and used to raise and lower the propeller 440 relative to the boat bottom 130 and plate 220. The drawing also shows the up and down path 851 of the propellers, the side to side motion 831 of the propellers, and the side to side motion 811 of the plates 220. This drawing depicts the motions of the components as heavy, dark line vectors. Note that the steering axis 561, 661 is angled inward for each propeller shaft 441.

Figure 36:
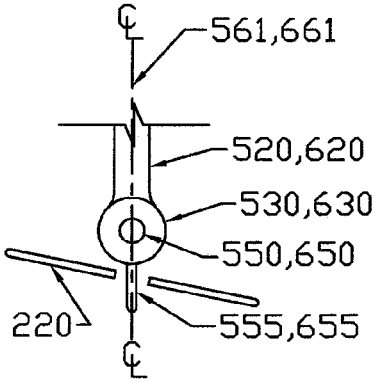
FIG. 36 shows an end view of a portion of a lower unit typical of an outboard motor or an inboard/outboard drive and located below is the plate typically mounted parallel to the sloped boat bottom.

FIG. 36 shows an end view of a portion of a lower unit gearcase 530, 630 typical of an outboard motor or an inboard/outboard drive including propeller shaft 550, 650. Located below the propeller shaft is the plate 220 typically mounted parallel to the sloped boat bottom 130 (not shown). It is anticipated that the lower unit can be mounted either vertically on the transom so that the steering axis 561, 661 is vertical, or can be mounted at an angle, as shown by inwardly angled steering axis 561, 661 of FIG. 35, to cause the propeller to sweep left and right in a path generally parallel to the bottom of the boat to follow the paths 831 shown in FIG. 35.

Figure 37:
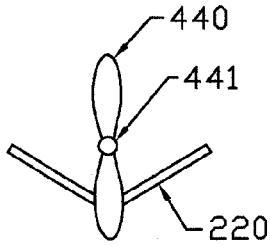
FIG. 37 shows an end view of a propeller and a "V" shape plate.

FIG. 37 shows an end view of a propeller 440 mounted to a propeller shaft 441 and a plate 220 wherein the plate is generally a "V" shape.

Figure 38:
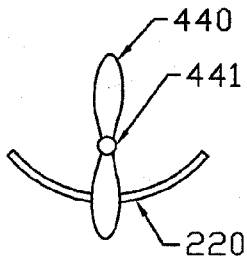
FIG. 38 shows an end view similar to FIG. 37 and shows a propeller and a "U" shape plate.

FIG. 38 shows an end view similar to FIG. 37 and shows a propeller 440 mounted to a propeller shaft 441 and a plate 220 wherein the plate is generally a "U" shape.

Although the present invention has been described in considerable detail with reference to certain preferred versions thereof, other versions and variations are possible and contemplated. Those skilled in the art should appreciate that they can readily use the disclosed conception and specific embodiments as a basis for designing or modifying other structures for carrying out the same purposes of the present invention without departing from the spirit and scope of the invention as defined by the appended claims.

The invention claimed is:

1. A water flow limiting system for mounting to a boat having a bottom with an undersurface, a propeller shaft and a propeller affixed to the propeller shaft, comprising:

a water flow limiting plate having a forward end and a rearward end and wherein said water flow limiting plate is configured so that said water flow limiting plate can be aligned generally parallel to the undersurface of the boat below the propeller shaft and forward of the propeller and is operative to limit water flow to the propeller;

a coupling mechanism that enables steering of said water flow limiting plate relative to the boat;

a controllable bite ram that controls vertical positioning of a rearward end of said water flow limiting plate relative to the propeller shaft; and a bracket mounted to said forward end of said water flow limiting plate and configured so that it can be mounted to the boat to maintain said forward end of said water flow limiting plate from moving below the undersurface of the boat when running in water.

2. The water flow limiting system of claim 1, wherein the propeller is steerable relative to the boat, wherein said forward end of said water flow limiting plate is pivotally mounted to said bracket, and wherein said coupling mechanism comprises a mounting mechanism which is for maintaining said water flow limiting plate generally aligned with the propeller.

3. The water flow limiting system of claim 1, wherein said coupling mechanism comprises a steering mechanism which is for steering said water flow limiting plate relative to the propeller, and wherein said forward end of said water flow limiting plate is pivotally mounted to said bracket.

4. The water flow limiting system of claim 1, wherein said water flow limiting plate has a width that is approximately equal to a diameter of the propeller.

5. The water flow limiting system of claim 1, further comprising a propeller guard system positioned above said water flow limiting plate comprising a plurality of rearwardly extendable guard tines.

6. The water flow limiting system of claim 1, further comprising a cooling coil affixed to an upper surface of said water flow limiting plate.

7. A water flow limiting system for mounting to a boat with a bottom having an undersurface, a propeller shaft and a propeller affixed to the propeller shaft, comprising:

a water flow limiting plate having a forward end and a rearward end and wherein said water flow limiting plate is configured so that said water flow limiting plate can be aligned generally parallel to the undersurface of the boat below the propeller shaft and forward of the propeller and is operative to limit water flow to the propeller;

a coupling mechanism that enables steering of said water flow limiting plate relative to the propeller shaft;

a controllable bite ram that controls vertical positioning of a rearward end of said water flow limiting plate relative to the propeller shaft; and a bracket mounted to said forward end of said water flow limiting plate and configured so that it can be mounted to the boat to maintain said forward end of said water flow limiting plate from moving below the undersurface of the boat when running in water.

8. The water flow limiting system of claim 7, wherein said water flow limiting plate has a width that is approximately equal to a diameter of the propeller.

9. A boat, comprising:

a hull with a bottom having an undersurface, a propeller shaft and a propeller affixed to said propeller shaft;

a water flow limiting plate which has a forward end and a rearward end and which is aligned generally parallel to said undersurface below said propeller axis of rotation and forward of said propeller and is operative to limit water flow to the propeller;

a coupling mechanism that enables steering of said water flow limiting plate relative to the boat;

a controllable bite ram that controls vertical positioning of a rearward end of said water flow limiting plate relative to said propeller shaft; and a bracket mounted to said forward end of said water flow limiting plate and mounted to the boat to maintain said forward end of said water flow limiting plate from moving below said undersurface of the boat when running in water.

10. The boat of claim 9, wherein said propeller is steerable relative to said hull, wherein said forward end of said water flow limiting plate is pivotally mounted to said bracket, and wherein said coupling mechanism comprises a mounting mechanism which maintains said water flow limiting plate generally aligned with said propeller.

11. The boat of claim 9, wherein said coupling mechanism comprises a steering mechanism which steers said water flow limiting plate relative to said propeller, and wherein said forward end of said water flow limiting plate is pivotally mounted to said bracket.

12. The boat of claim 9, wherein said water flow limiting plate has a width that is approximately equal to a diameter of said propeller.

13. The boat of claim 9, further comprising a propeller guard system positioned above said water flow limiting plate comprising a plurality of rearwardly extendable guard tines.

14. The boat of claim 9, further comprising a cooling coil affixed to an upper surface of said water flow limiting plate.

15. A boat, comprising:

a hull with a bottom having an undersurface, a propeller shaft, and a propeller affixed to said propeller shaft;

a water flow limiting plate which has a forward end and a rearward end and which is aligned generally parallel to said undersurface below said propeller shaft and forward of said propeller and is operative to limit water flow to said propeller;

a coupling mechanism that enables steering of said water flow limiting plate relative to said propeller shaft;

a controllable bite ram that controls vertical positioning of a rearward end of said water flow limiting plate relative to said propeller shaft; and a bracket mounted to said forward end of said water flow limiting plate and mounted to the boat to maintain said forward end of said water flow limiting plate from moving below said undersurface of the boat when running in water.

16. The boat of claim 15, wherein said water flow limiting plate has a width that is approximately equal to a diameter of said propeller.

* * * * *